United States Patent [19]

Tabur

[11] 4,188,770

[45] Feb. 19, 1980

[54] MACHINE FOR PACKAGING VARIOUS ARTICLES

[76] Inventor: Marcel J. Tabur, Boulevard Pierre Lefaucheux, 72100 Le Mans, Sarthe, France

[21] Appl. No.: 859,940

[22] Filed: Dec. 12, 1977

[51] Int. Cl.[2] ..... B65B 31/02

[52] U.S. Cl. ..... 53/509; 53/141

[58] Field of Search ..... 53/112 A, 141, 22 A, 53/509

[56] References Cited

U.S. PATENT DOCUMENTS

| | | | |
|---|---|---|---|
| 2,925,694 | 2/1960 | Walther et al. | 53/467 |
| 3,377,770 | 4/1968 | Rorer | 53/112 A |
| 3,848,393 | 11/1974 | Monoghan | 53/112 A X |
| 3,910,008 | 10/1975 | Johnson | 53/112 A |
| 4,050,971 | 9/1977 | Verkins et al. | 53/296 X |
| 4,077,184 | 3/1978 | Kremer et al. | 53/509 |

*Primary Examiner*—Travis S. McGehee

*Attorney, Agent, or Firm*—Robert W. Beach; Ward Brown

[57] ABSTRACT

Articles to be packaged are brought by a conveyor above a vacuum chamber and a preheated plastic film is sucked toward a cardboard sheet supporting the articles and resting on the conveyor.

15 Claims, 9 Drawing Figures

A
B
C
D
F1
1
2
3
4
4a
5
6
7
8
9
10
11
12
13
14
15
16
17
35
46
48

A
B
C
D
A1
B1
C1
D1
2
3
4
7
13
15
17
18
19
48
VII
VII 39
40
36
37
38
41
42
44
43
10
46

36
39
35
38
44
43
45
46

MACHINE FOR PACKAGING VARIOUS ARTICLES

BACKGROUND OF THE INVENTION

1. Field of the Invention

The present invention relates to a machine used for packaging various articles under a plastic film.

2. Prior Art

Known machines comprise a vacuum chamber which carries a cardboard sheet supporting one or several similar articles over which is draped a plastic film which previously has been heated. The cardboard sheet then is removed from the vacuum chamber.

SUMMARY OF THE INVENTION

The present invention relates to a machine enabling articles to be positioned on backings or substrates at several loading stations and enabling successive packaging of articles or sets of articles under a plastic film. Such articles can be of completely different natures.

Still more particularly, the machine of the invention is provided for packaging under a plastic film articles directly on the portion of a support which will afterwards constitute a box or a case.

The machine of the invention is particularly suitable for mail order selling since it permits the gathering of the various orders of a given customer under one plastic film, such orders being placed directly on a support which afterwards will form the shipping box.

According to the invention, the machine for packaging at least one article under a plastic film on a support, in which a thermoplastic film is heated and then draped and formed by suction over at least one article and its support, comprises a vacuum chamber having a perforated surface forming a sliding way for a conveyor of which some areas are also perforated and by which the article placed on its support is brought above said chamber, and means for preparing, heating and delivering a thermoplastic film above said chamber and the portion of the conveyor which covers it, whereby the packaging is performed on the conveyor itself, said conveyor afterwards removing the packaged article.

DETAILED DESCRIPTION

Figure 1:
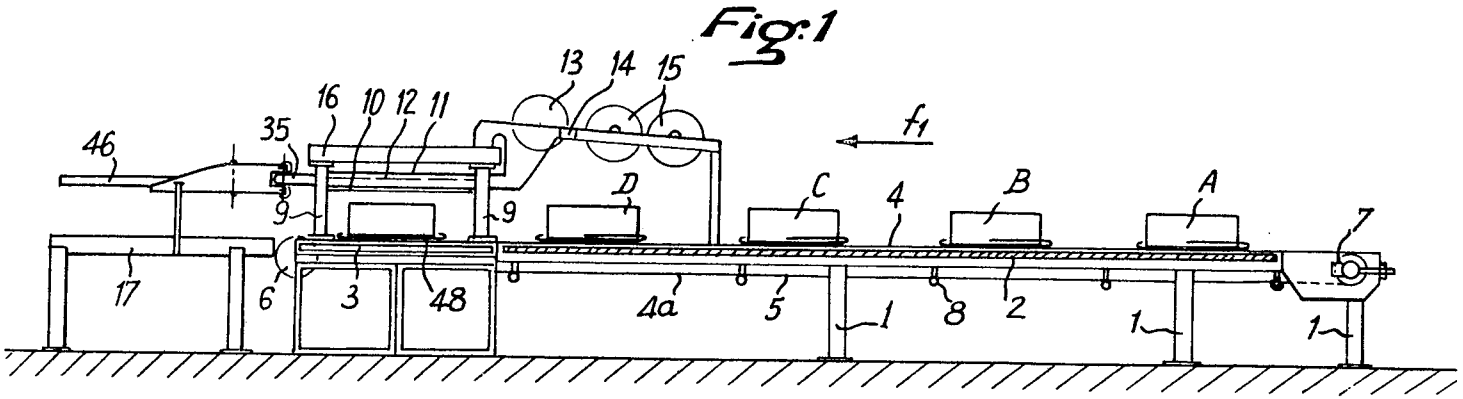
FIG. 1 is a diagrammatic side elevation view of the whole packaging machine of the invention.

Referring now to the drawings, the machine of the present invention comprises a base 1 supporting an elongated table 2 whose top is aligned with a vacuum chamber 3 described in greater detail with reference to FIG. 3. The upper surface of table 2 advantageously has at least one coating of smooth low-friction material, for example a coating of slippery synthetic resin. The table 2 and the top of the vacuum chamber 3 support the upper run 4 of an endless belt conveyor 5 extending around roller 6, 7, the latter being, for example, a tightening roller while the other is a driving roller. The lower run 4*a* of the conveyor 5 is supported by idler rollers or other supporting means 8.

Columns 9 are provided above the vacuum chamber for guiding complementary shaped drape frames 10 and 11 for holding a thermoplastic film 12 unwound from a supply spool 13 supported by a frame 14. Other spools 15 are carried by such frame positioned for subsequent use. Columns 9 also support a heating unit 16 for heating the thermoplastic film 12 when the same is held between the frames 10, 11.

A discharge conveyor 17 is provided beyond the roller 6 in alignment with the upper run 4 of the endless conveyor 5. The discharge conveyor is, for example, constituted by an endless belt moved at a higher speed than the conveyor 5. Articles, such as those shown at A, B, C, D, are moved in the direction of arrow $f_1$ by the conveyor 5, packaged above the vacuum chamber 3, and then shifted to the discharge conveyor 17.

The conveyor belt 5 is made of reinforced synthetic resin, and has perforated areas 18 uniformly spaced lengthwise of the conveyor by imperforate areas 19. It can be seen in FIG. 2 that adjacent perforated areas 18 are spaced apart a distance equal to the distance between adjacent loading stations of uniformly spaced loading stations A1, B1, C1, D1 from which articles A, B, C, D, respectively, have been shifted onto the conveyor.

The conveyor 5 is shifted incrementally step-by-step, the increment of forward shift being selected so that with each shift a new perforated area 18 is placed in registration over the vacuum chamber 3.

Figure 3:
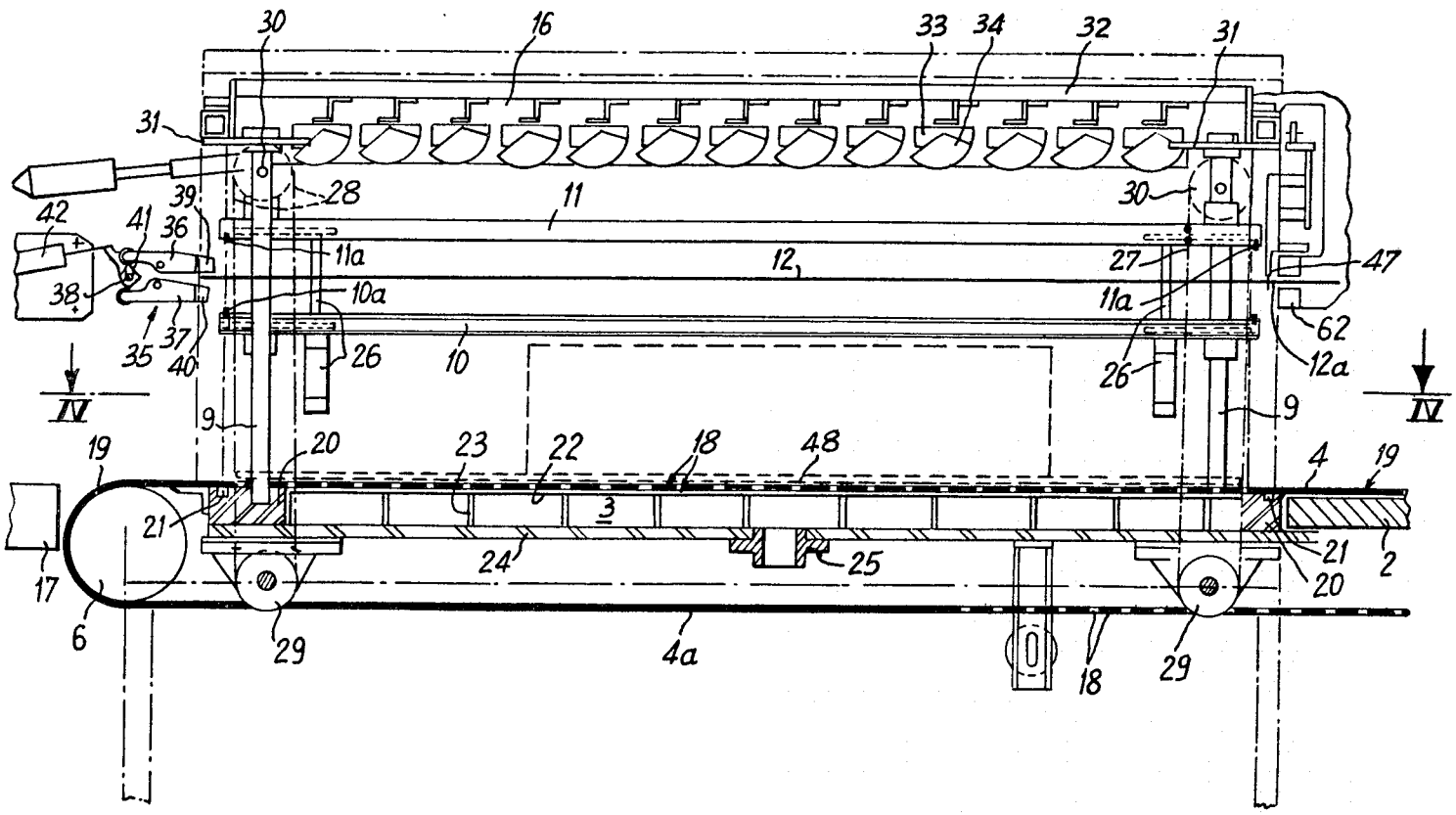
FIG. 3 is a somewhat diagrammatic longitudinal vertical cross-sectional view of the packaging station of the machine of FIG. 1 with parts broken away.
Figure 4:
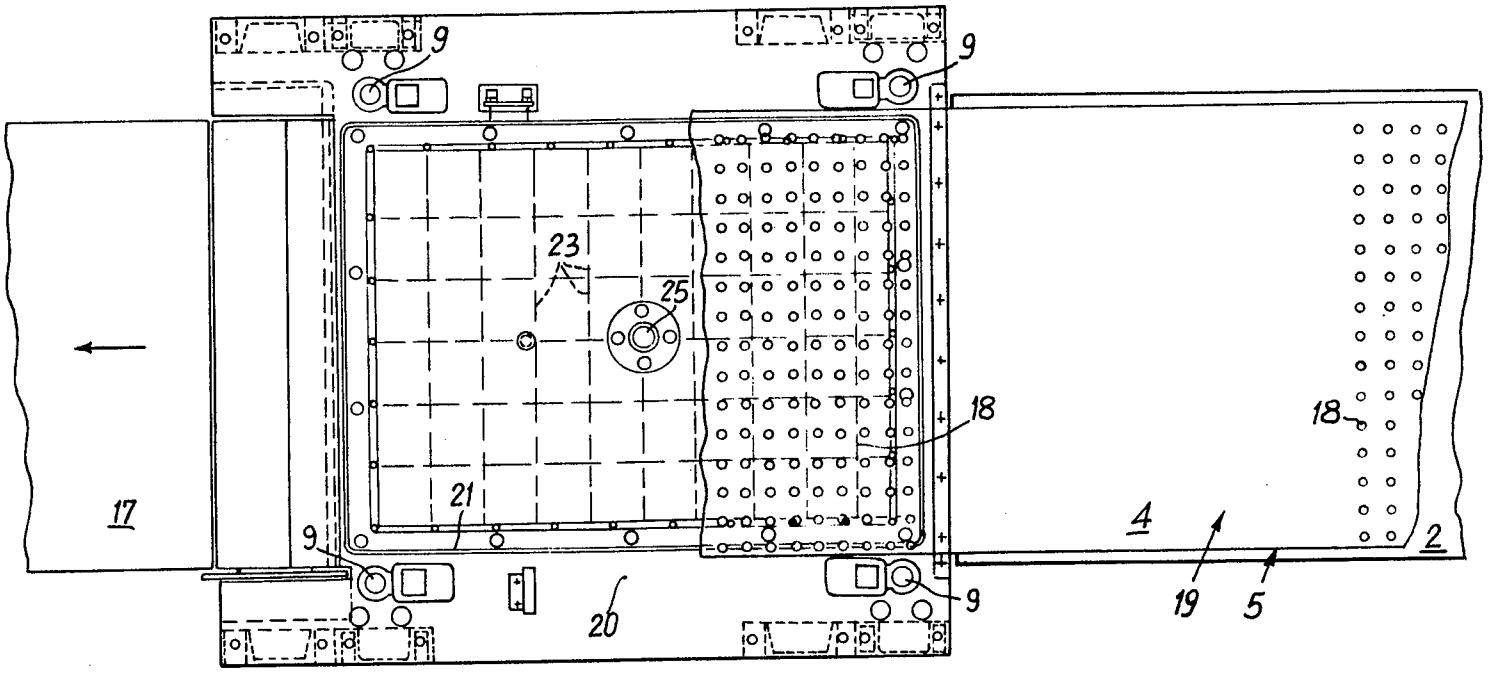
FIG. 4 is a section, taken substantially along line IV—IV of FIG. 3 with parts broken away.

As shown in FIGS. 3 and 4, the upper side of the vacuum chamber has a bordering peripheral plate 20 having a continuous sealing gasket 21 located below the upper run of the conveyor belt and extending around the conveyor belt perforated portion 18 at the vacuum chamber. A vacuum platen is formed by a perforated metal sheet 22 supported by crosspieces 23 also made of perforated metal sheet. These crosspieces rest on and are supported by a bedplate 24 which also supports the peripheral plate 20. A nozzle 25 connected to a vacuum pump (not shown) opens at the center of the bedplate.

The peripheral plate 20 supports guiding columns 9 on which the drape frames 10 and 11 can slide conjointly vertically toward and away from the vacuum chamber. Control cylinders 26 are provided to shift the frames vertically relative to each other between the separated position shown in FIG. 3 and a film-clamping position in which the facing surfaces of the frames are nearly in engagement.

Opposite ends of the frames, i.e. the frame 11 in the example represented, are connected, respectively, to cables or chains 27, 28, encircling sprocket wheels 29, 30 to move the two frames conjointly as described hereinbelow. The upper portions of columns 9 are connected by crossbeams 31 (FIG. 3) and also by girders 32 from which are hung radiant heating means 33 provided with movable heat shields 34.

To bring a portion of film 12 between the frames 10 and 11, the machine comprises a pliers 35 which has arms generally shown at 36 and 37. The arms 36 and 37 are formed by levers mounted at the end on a control shaft 38; said levers forming the arms 36, 37 are connected by bars 39, 40 having a length at least equal to the width of the film 12 that said bars must catch between them.

Figures 5, 6:
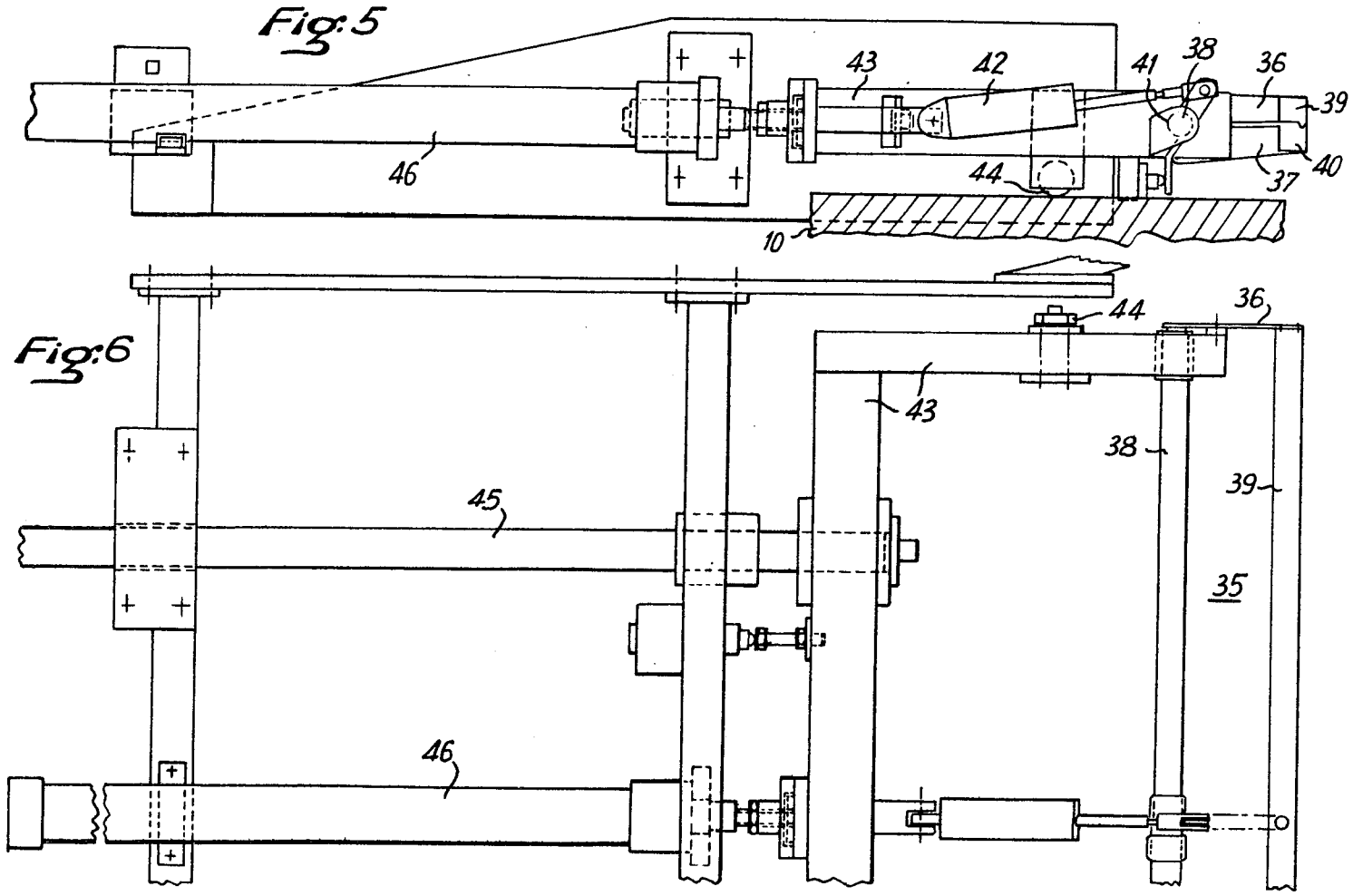
FIG. 5 is a very enlarged diagrammatic side elevation view of a working portion illustrated in FIG. 1.
FIG. 6 is a top plan view of the working portion shown in FIG. 5.

The shaft 38 controls the pliers 36, 37 by a cam mechanism 41 which is operated by a cylinder 42 (FIG. 5). The shaft 38 and cylinder 42 are supported by a carriage 43 having wheels 44 to roll along the sides of the frame 10 when it is in the position shown in FIG. 3. The carriage 43 is axially guided by columns 45 of which only one is shown in FIG. 6, and the motion of said carriage is controlled by a cylinder 46 having a long stroke since the pliers 35 must be moved from the downstream position it occupies in FIG. 3 to the position immediately contiguous to a cutting means 47 located at the upstream end of the frames 10, 11 to cut the film 12 when it is moved between the frames.

The cutting means 47, shown in FIG. 3, can be of different types, for example, a transversely movable blade or a guillotine mechanism of the trimmer type. The particular type of cutting means not being a feature of the invention, it is not described in more detail.

The articles A, B, C . . . can be either bulky articles, such as bicycle wheels or schoolbags, or a plurality of small articles which must be packed side by side. The nature of the articles can vary widely, for example, the articles can include a pair of tongs, a set of nails, a measuring device, etc. The articles are placed on a substrate such as a cardboard sheet 48 which is itself placed on a movable table 49 bordered by strips 50, best seen in FIGS. 7 and 8.

Figure 7:
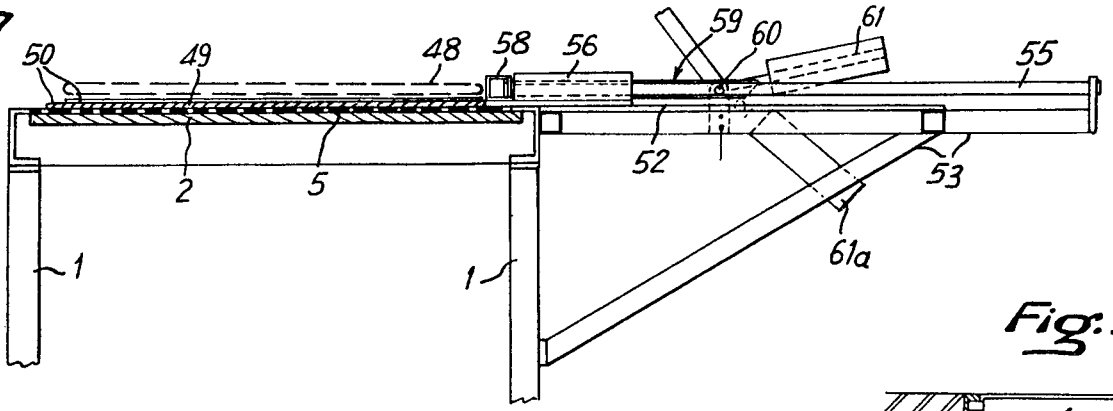
FIG. 7 is a cross section, partly diagrammatic, taken along line VII—VII of FIG. 2.
Figure 9:
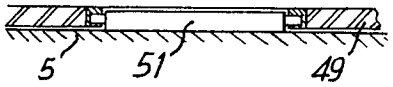
FIG. 9 is a very enlarged cross section taken along line IX—IX of FIG. 8.
Figure 8:
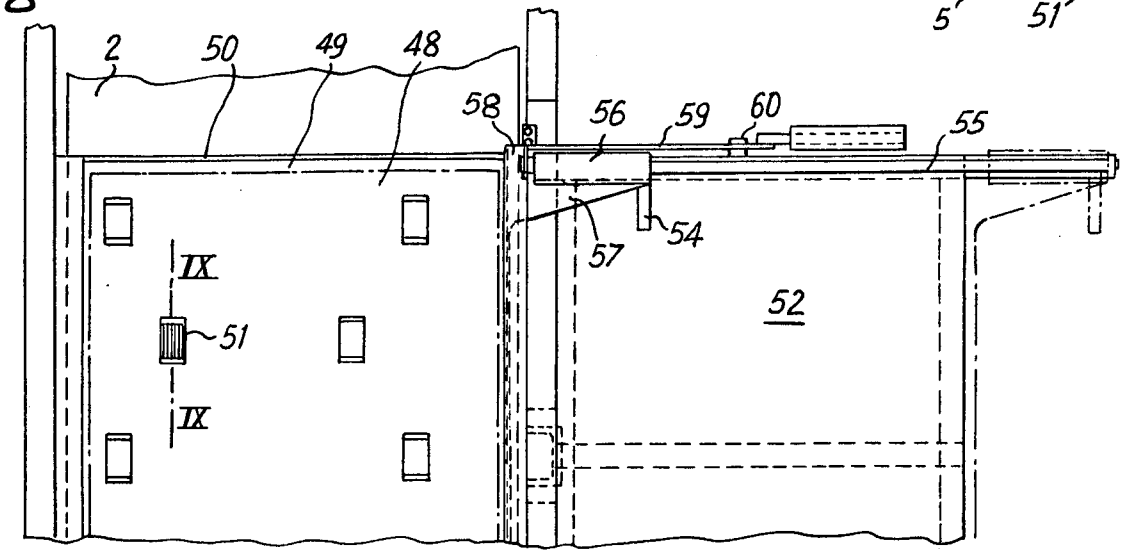
FIG. 8 is a fragmentary top plan view corresponding to FIG. 7.

The mobile table 49 comprises live rollers 51 mounted within the thickness of the table to enable it to roll, on the one hand, on the conveyor 5 in the position shown in FIGS. 7 and 8, and, on the other hand, on a plate 52 supported by a bracket 53 constituting one of the loading stations A1, B1, C1 . . . . The table 49 may be moved, for example, manually by means of handles 54 and is guided by rods received in sockets 56 fixed on protruding portions 57 of the table.

The loading stations also comprise retaining strips 58 mounted on levers 59 hinged on pins 60 and balanced by means of a counterweight 61.

The machine of the invention operates as follows:

First, an operator places a cardboard sheet 48 on the movable table 49 of the loading station in front of which he is located, such movable table being positioned above its plate 52. The retaining strip 58 is lifted and held in the raised position by its counterweight 61 which is in the position 61*a*. The cardboard sheet 48 is centered by the strips 50 which border the lateral sides of the movable table 49. Then the operator places the single article or the various articles to be packed on the cardboard sheet, and moves the movable table 49 by the handles 54 to bring the table into the position represented in FIGS. 7 and 8. The rollers 51 roll on the conveyor 5 which, consequently, is not subjected to any friction stress. Then the operator swings the retaining strip 58 down and uses such strip as an abutment for the cardboard sheet 48 as illustrated in FIG. 7. At this time, the operator can roll the movable table 49 back off the conveyor and onto its plate 52.

Figure 2:
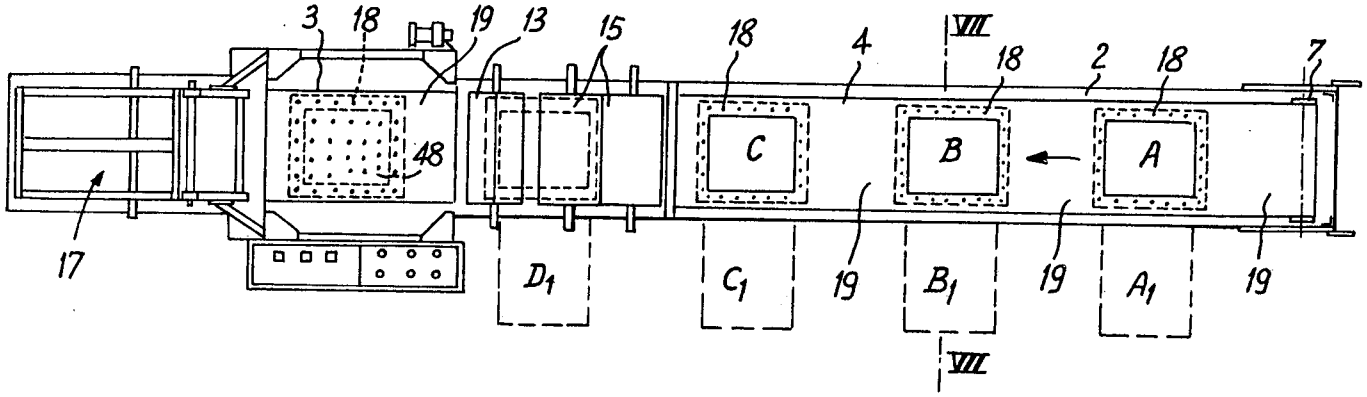
FIG. 2 is a diagrammatic top plan of the machine of FIG. 1.

During that motion, the cardboard sheet 48 is retained by the strip 58 so that, at the end of motion of the table 49, it, as well as the articles that it carries, is placed on a perforated portion of the upper run of the conveyor 5. The time required for an operator to prepare the cardboard sheet and the articles is substantially longer than the time necessary for the packaging. It is thus possible to have on a single machine four loading stations, for example, as represented in FIG. 2, or more or fewer stations.

The forward motion of the conveyor being intermittent, but each movement being a predetermined increment, the above described cardboard sheet 48, as well as the article or articles supported thereby, are eventually brought to the vacuum packaging station illustrated in FIGS. 3 and 4. The film 12 moves forward simultaneously with the conveyor 5, i.e. the pliers 35 catch the end 12*a* (FIG. 3) of the film held by a clamp 62 before the forward increment of movement of the conveyor 5, then the pliers 35 are brought back to the position shown in FIG. 3 by the cylinder 46 during the advance of the conveyor and after the clamp 62 has opened.

The frames 10 and 11 are then brought together by the cylinders 26 connecting them, and the film 12 which is gripped by the pliers 35 is clamped tightly between the plastic joints 10*a*, 11*a* of the frames 10 and 11. The cutting device 47 is operated immediately after the clamp 62 has gripped the end of the film 12*a* coming from the spool 13.

The frames 10, 11 holding the cut portion of the film 12 are then raised to approach the heating components 33, and the heat shields 34 are moved so that the film 12 is heated very quickly. The frames 10, 11 are then lowered by the chains 27, 28 to lower the hot and pliable film, and drape it over the article or articles supported by the cardboard sheet 48 while simultaneously the vacuum platen 22 is evacuated, fixing the film 12 to the cardboard sheet.

The frames 10, 11 are at that moment in their lowered position, i.e., the frames 10 and 11 surround the cardboard sheet 48. The cylinders 26 lift the frame 11 away from frame 10, which clears the periphery of the film 12, and it becomes possible to lift the frame 10 which consequently drives the two frames to the position illustrated in FIG. 3. The pliers 35 perform a new stroke toward the right of the drawing to catch the end 12*a* of the film while being held by clamp 62, and a new cycle of operation occurs. The cardboard sheet 48 supporting the article or articles which have just been encased by the film 12 are transferred to the removing conveyor 17.

It is more particularly important, in the preferred embodiment of the invention, that the cardboard sheet 48 be precut and preshaped, and also that such sheet be flat. Thus the articles are directly fixed on a portion of the sheet which can constitute the bottom portion or a side portion of a shipping package.

The invention is not restricted to the embodiment shown and described in detail, for various modifications can be made without departing from the scope of the invention as defined by the appended claims.

What we claim is:

1. In a machine for packaging at least one article between a substrate supporting such article and a plastic film, such machine including a vacuum chamber having a perforated vacuum platen, a conveyor belt having several perforated portions spaced substantially uniformly lengthwise of such belt for supporting the substrate and imperforate portions located between said perforated portions, means for shifting the conveyor belt incrementally for moving the substrate unidirectionally to the vacuum chamber and for registering the belt perforated portions with the vacuum chamber platen successively for predetermined periods and means adjacent to the vacuum chamber for draping the plastic film over the article and the substrate, the improvement comprising the draping means including two cooperating frames, means for supplying a section of plastic film between said frames and means for moving said frames relatively toward each other for clamping the section of plastic film between said frames and conjointly toward the vacuum platen, said film-supplying means including a supply spool carrying a quantity of the plastic film, a pliers for gripping an end portion of the plastic film and means for moving said pliers for pulling a section of the film between the frames.

2. In the machine defined in claim 1, the draping means including film heating means above the two frames, and the frame-moving means moving the two frames conjointly toward the heating means prior to their movement toward the vacuum platen.

3. In the machine defined in claim 1, the framemoving means including first moving means for moving the frames relatively toward and away from each other and second moving means for moving the frames conjointly toward and away from the vacuum platen.

4. In the machine defined in claim 1, the pliers moving means including a carriage carrying the pliers and means for moving said carriage along one of the frames.

5. In the machine defined in claim 1, the belt extending a substantial distance upstream from the vacuum platen, and a laterally disposed loading structure adjacent to the belt and spaced from the vacuum platen a distance substantially equal to an integer multiple of the distance between adjacent perforated belt portions.

6. In the machine defined in claim 5, several laterally disposed loading structures each spaced from the vacuum platen a distance substantially equal to an integer multiple of the distance between adjacent perforated belt portions.

7. In the machine defined in claim 6, each loading structure including a movable table having a tabletop and means guiding said table for movement between a position in which said tabletop overlies the conveyor belt and a position in which said tabletop is retracted from the conveyor belt.

8. In the machine defined in claim 7, each table including elements for centering substrate on the tabletop of such table and means for effecting transfer of substrate from such tabletop to the conveyor as such tabletop is being retracted from the conveyor.

9. In the machine defined in claim 8, the tabletop having rollers for rolling along the conveyor when the tabletop is overlying the conveyor belt.

10. In a machine for packaging at least one article between a substrate supporting such article and a plastic film, such machine including a vacuum chamber, conveyor means extending upstream from the vacuum chamber for moving the substrate to the vacuum chamber, a frame supporting the conveyor means and means for draping plastic film over the article and the substrate, the improvement comprising a loading station located adjacent to the conveyor means and upstream from the vacuum chamber, said loading station including a movable table having a tabletop for supporting the substrate, means guiding said table for movement between a position in which said tabletop overlies the conveyor means and a position in which said tabletop is retracted from the conveyor means and retainer means mounted on the frame for effecting transfer of the substrate onto the conveyor means by movement of the tabletop from its position overlying the conveyor means to its position retracted from the conveyor means.

11. In the machine defined in claim 10, the table including elements for centering the substrate on the tabletop.

12. In the machine defined in claim 11, the conveyor means including a conveyor belt, and the tabletop having rollers for rolling along said conveyor belt when the tabletop is overlying said conveyor belt.

13. In a machine for packaging at least one article between a substrate supporting such article and a plastic film, such machine including a vacuum chamber having a perforated vacuum platen, a conveyor belt having several perforated portions spaced substantially uniformly lengthwise of such belt for supporting the substrate and imperforate portions located between said perforated portions, means for shifting the conveyor belt incrementally for moving the substrate unidirectionally to the vacuum chamber and for registering the belt perforated portions with the vacuum chamber platen successively for predetermined periods and means adjacent to the vacuum chamber for draping the plastic film over the article and the substrate, the improvement comprising the conveyor belt extending a substantial distance upstream from the vacuum platen, and several loading stations each adjacent to the belt and spaced from the vacuum platen a distance substantially equal to an integer multiple of the distance between adjacent perforated belt portions, each loading station including a movable table having a tabletop and means guiding said table for movement between a position in which said tabletop overlies the conveyor belt and a position in which said tabletop is retracted from the conveyor belt, each table including elements for centering substrate on the tabletop of such table and a retainer strip engageable with substrate and swingable toward and away from the tabletop for effecting transfer of substrate from such tabletop to the conveyor as such tabletop is being retracted from the conveyor.

14. In a machine for packaging at least one article between a substrate supporting such article and a plastic film, such machine including a vacuum chamber, conveyor means extending upstream from the vacuum chamber for moving the substrate to the vacuum chamber and means for draping plastic film over the article and the substrate, the improvement comprising a loading station located adjacent to the conveyor means and upstream from the vacuum chamber, said loading station including a movable table having a tabletop and means guiding said table for movement between a position in which said tabletop overlies the conveyor means and a position in which said tabletop is retracted from the conveyor means, said table including elements for centering the substrate on the tabletop and a retainer strip engageable with the substrate on the tabletop and swingable toward and away from the tabletop for transferring the substrate from the tabletop to the conveyor means as the tabletop is being retracted from the conveyor means.

15. In a machine for packaging at least one article between a substrate supporting such article and a plastic film, such machine including: a vacuum chamber; a conveyor including means for supporting the substrate and means for shifting the supporting means incrementally for moving the substrate unidirectionally to the vacuum chamber and for registering the supporting means with the vacuum chamber successively for predetermined periods; and means adjacent to the vacuum chamber for draping the plastic film over the article and the substrate; the improvement comprising the draping means including two cooperating frames, means for supplying a section of plastic film between said frames and means for moving said frames relatively toward each other for clamping the section of plastic film between said frames and conjointly toward the vacuum platen, said film-supplying means including a supply spool carrying a quantity of the plastic film, a pliers for gripping an end portion of the plastic film and means for moving said pliers for pulling a section of the film between the frames.

* * * * *